US007828562B2

(12) United States Patent
Wu

(10) Patent No.: US 7,828,562 B2
(45) Date of Patent: Nov. 9, 2010

(54) ELECTRICAL CONNECTOR

(75) Inventor: Yongquan Wu, Anlu (CN)

(73) Assignee: Lotes Co., Ltd., Keelung (TW)

( * ) Notice: Subject to any disclaimer, the term of this patent is extended or adjusted under 35 U.S.C. 154(b) by 127 days.

(21) Appl. No.: 12/314,793

(22) Filed: Dec. 17, 2008

(65) Prior Publication Data

US 2010/0003868 A1 Jan. 7, 2010

(30) Foreign Application Priority Data

Jul. 1, 2008 (CN) ..... 2008 2 0119160 U

(51) Int. Cl.
*H01R 12/00* (2006.01)

(52) U.S. Cl. ..... 439/83; 439/876; 439/884

(58) Field of Classification Search ..... 439/83, 439/862, 874–876, 884
See application file for complete search history.

(56) References Cited

U.S. PATENT DOCUMENTS 6,056,558 A * 5/2000 Lin et al. ..... 439/83
6,533,590 B1 * 3/2003 Lee et al. ..... 439/83
6,572,397 B2 * 6/2003 Ju ..... 439/342
6,692,265 B2 * 2/2004 Kung et al. ..... 439/68
6,929,488 B2 * 8/2005 Kung et al. ..... 439/83
7,147,489 B1 * 12/2006 Lin ..... 439/83
7,377,789 B1 * 5/2008 Liu ..... 439/66
2006/0258191 A1 * 11/2006 Chen ..... 439/83
2010/0003868 A1 * 1/2010 Wu ..... 439/884

* cited by examiner

*Primary Examiner*—James Harvey
(74) *Attorney, Agent, or Firm*—Rosenberg, Klein & Lee

(57) ABSTRACT

An electrical connector includes a base having a plurality of through holes, and a plurality of conducting pins respectively located in the through holes. There is a convex block located at the side wall of the base for each of the through holes. Each of the conducting pins has an arm portion. The arm portion and the convex block are located at the same side. The arm portion has a through opening, and one end of the arm portion is bent and extended to form a contacting portion. The contacting portion has an opening that links with the through opening to form a channel that makes the convex block pass through the channel without interference. Because of the lack of interference, the conducting pin will not be damaged due to contact with the convex block when the conducting pin is installed into the through hole.

7 Claims, 11 Drawing Sheets

ELECTRICAL CONNECTOR

BACKGROUND OF THE INVENTION

1. Field of the Invention

The present invention relates to an electrical connector.

2. Description of Related Art

As shown in FIG. 11, the electrical connector includes a base 5, conducting pins 6 received in the receiving holes 51 of the base 5, and solder ball 7. In order to prevent the solder ball 7 from moving upwards too much and be wedged by the inside of the conducting pins 6, which would cause the solder ball 7 unable to float freely and thereby unable to contact the circuit board (not shown in the figure), a general solution in industry: a convex block 511 is located at the side wall of the receiving holes 51 of the base 5. The convex block 511 is located above the solder ball 7 to prevent the solder ball 7 from moving upwards too much. However, this method has the following drawback. As shown in FIG. 12, because the width w1 of the convex block 511 is larger than the width w2 of the opening of the conducting pin 6, the area of the conducting pin 6 located at outside of the opening will resist the convex block 511 when the conducting pin 6 is installed into the receiving hole 51. Thereby, the convex block 511 exerts a larger force to the conducting pin 6 so that it is difficult to install the conducting pin 6 into the receiving hole 51. The conducting pin 6 is easily deformed and leading to inexact connection with an electronic element (not shown in the figure) that is intended for connection via the electric connector, thereby negatively affects conduction.

Therefore, it is necessary to design a novel electrical connector to overcome the above-mentioned problems.

SUMMARY OF THE INVENTION

One particular aspect of the present invention is to provide an electrical connector that can prevent conducting pin of the electrical connector from being damaged and assure exact conduction connection between the conducting pin and an electronic element that is to be connected via the electrical connector.

The electrical connector includes a base having a plurality of through holes, and a plurality of conducting pins respectively located in the through holes. There is a convex block located at the side wall of the base for each of the through holes. Each of the conducting pins has an arm portion. The arm portion and the convex block are located at the same side. The arm portion has a through opening, and one end of the arm portion is bent and extended to form a contacting portion. The contacting portion has an opening that links with the through opening to form a channel so that the convex block can freely pass through the channel.

The electrical connector includes a base having a plurality of through holes, and a plurality of conducting pins respectively located in the through holes. There is a convex block located at the side wall of the base for each of the through holes. Each of the conducting pins has an arm portion. The arm portion and the convex block are located at the same side. The arm portion has a through opening, and one end of the arm portion is bent and extended to form a contacting portion. The contacting portion has an opening that links with the through opening to form a channel which corresponds to the convex block and the width of a position of the convex block is smaller than the width which corresponds to the position of the channel.

The electrical connector includes a base having a plurality of through holes, and a plurality of conducting pins respectively located in the through holes. There is a convex block located at the side wall of the base for each of the through holes. Each of the conducting pins has an arm portion. The arm portion and the convex block are located at the same side. The arm portion has a through opening, and one end of the arm portion is bent and extended to form a contacting portion. The contacting portion has a channel for receiving the convex block when the conducting pins are plugged into the through holes.

The present invention has the following characteristics. The conducting pin forms a channel so that the convex block can freely pass through the channel, the convex block corresponds to the channel and the width of a position of the convex block is smaller than the width which corresponds to the position of the channel, or the contacting portion has a channel for receiving the convex block when the conducting pins are plugged into the through holes. Therefore, the conducting pin will not be damaged due to contact with the convex block, and the conducting pin will exactly conduct with the electronic element.

For further understanding of the present invention, reference is made to the following detailed description illustrating the embodiments and examples of the present invention. The description is for illustrative purpose only and is not intended to limit the scope of the claim.

BRIEF DESCRIPTION OF THE DRAWINGS

The drawings included herein provide a further understanding of the present invention. A brief introduction of the drawings is as follows.

DETAILED DESCRIPTION OF PREFERRED EMBODIMENTS

Figure 1:
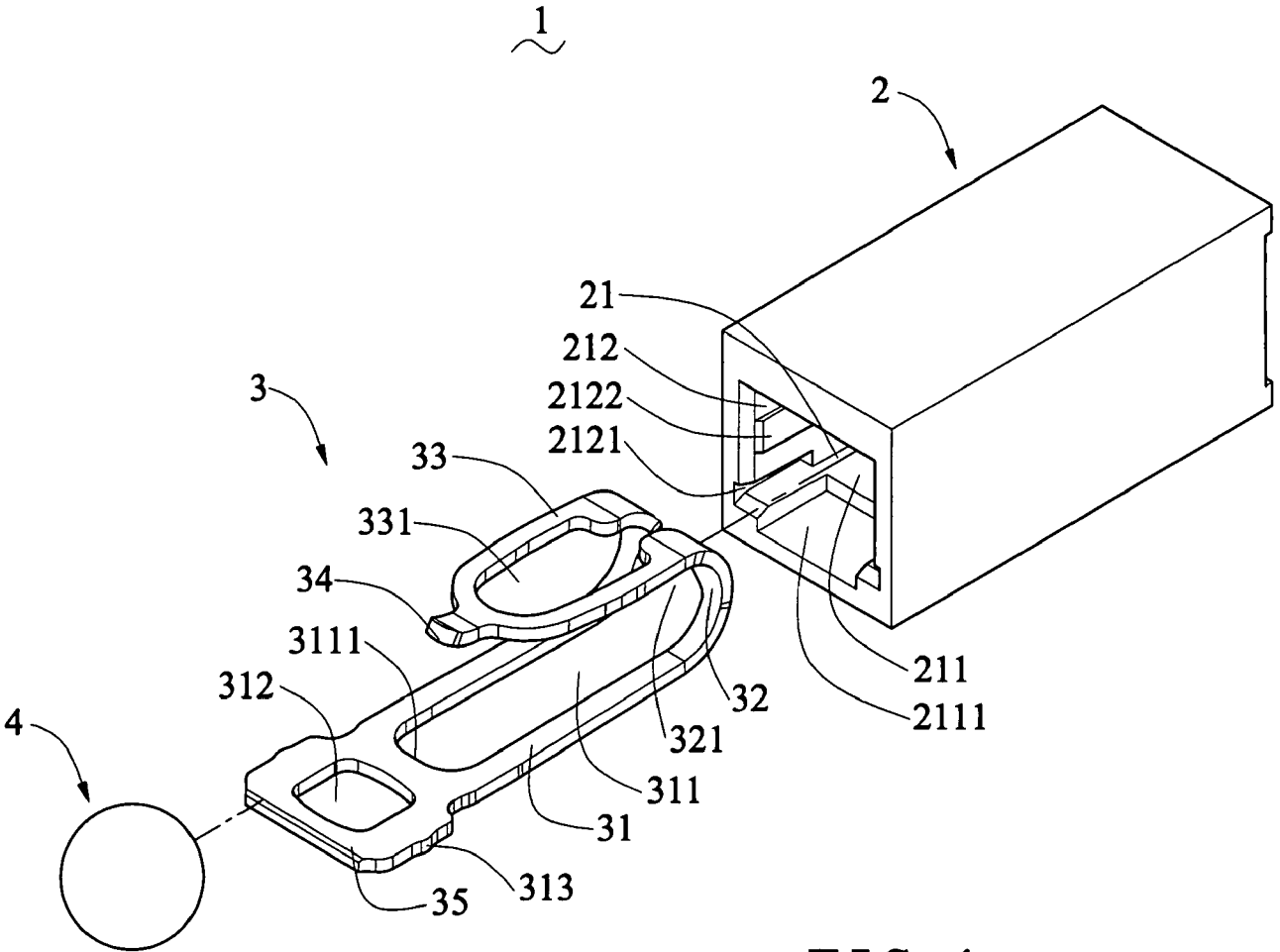
FIG. 1 is an exploded perspective view of the electrical connector of the first embodiment of the present invention.
Figure 2:
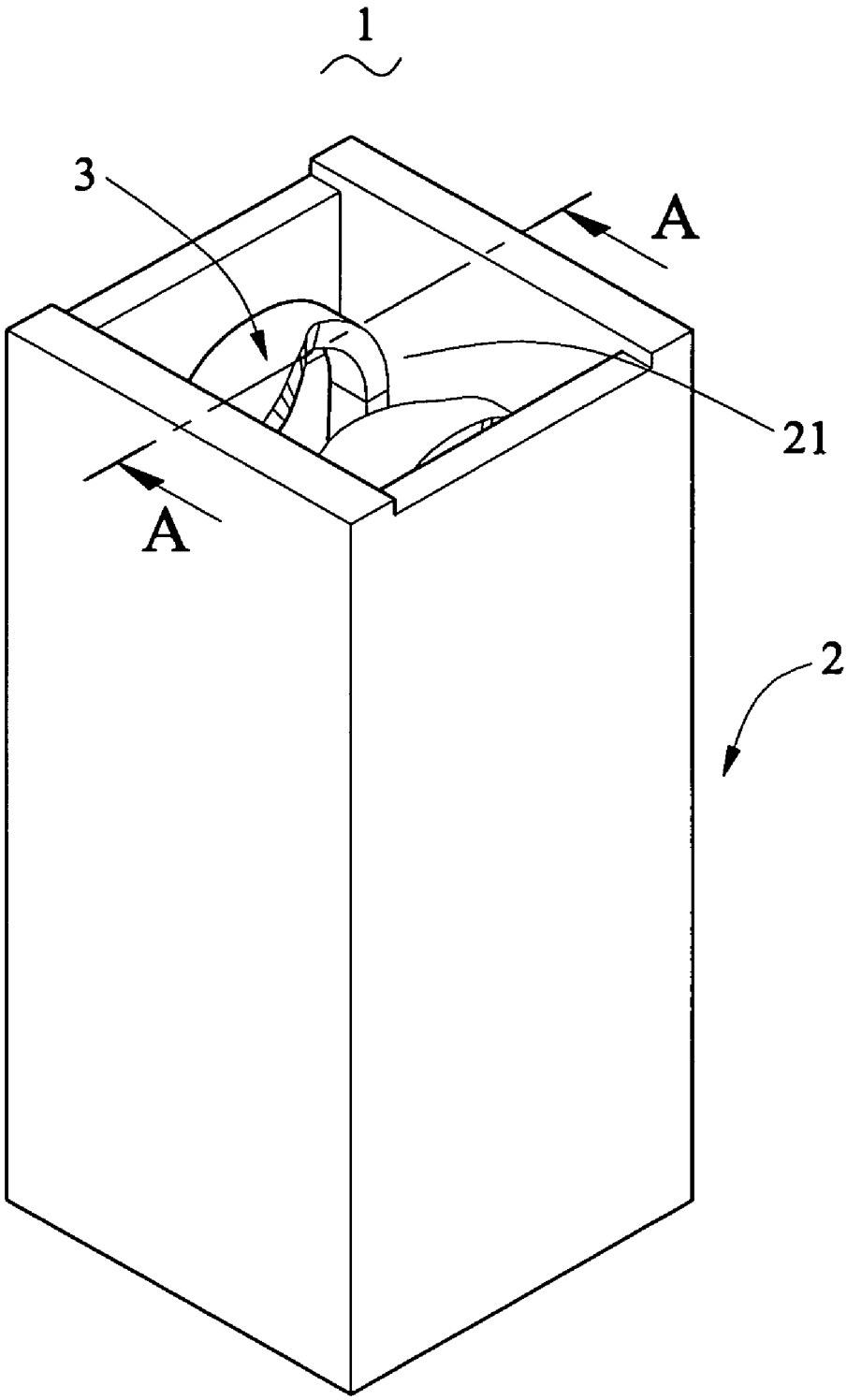
FIG. 2 is an assembly perspective view of the electrical connector in FIG. 1.

Reference is made to FIGS. 1-7, which shows an electrical connector 1 of the first embodiment of the present invention. The electrical connector 1 includes a base 2, a plurality of conducting pins 3 received in the base 2, and a plurality of soldering material 4, (in this embodiment, the soldering material is solder balls 4, and only one solder ball is shown in the figure).

Reference is made to FIGS. 1, 3, 4, and 6, the base 2 has a plurality of through holes 21 (in this embodiment, only one through hole is shown in the figure). The base 2 has a first side wall 211 for each of the through holes 21. The first side wall 211 has a concave slot 2111 passing through the bottom of the first side wall 211. A convex block 2112 is located above the concave slot 2111. The base 2 has a second side wall 212 in the through hole 21 that is adjacent to the two sides of the first side wall 211. One side of the bottom of the second side wall 212 has a gap 2121. The center of the bottom of the second side wall 212 protrudes to form position-limit block 2122. The base 2 has a third side wall 213 in the through hole 21 that is opposite to the first side wall 211. The bottom of the third side wall 213 protrudes to form a position-block portion 2131. Two sides of the third side wall 213 respectively protrude to form a holding block 2132. The holding block 2132 is located above the position-block portion 2131.

Figure 3:
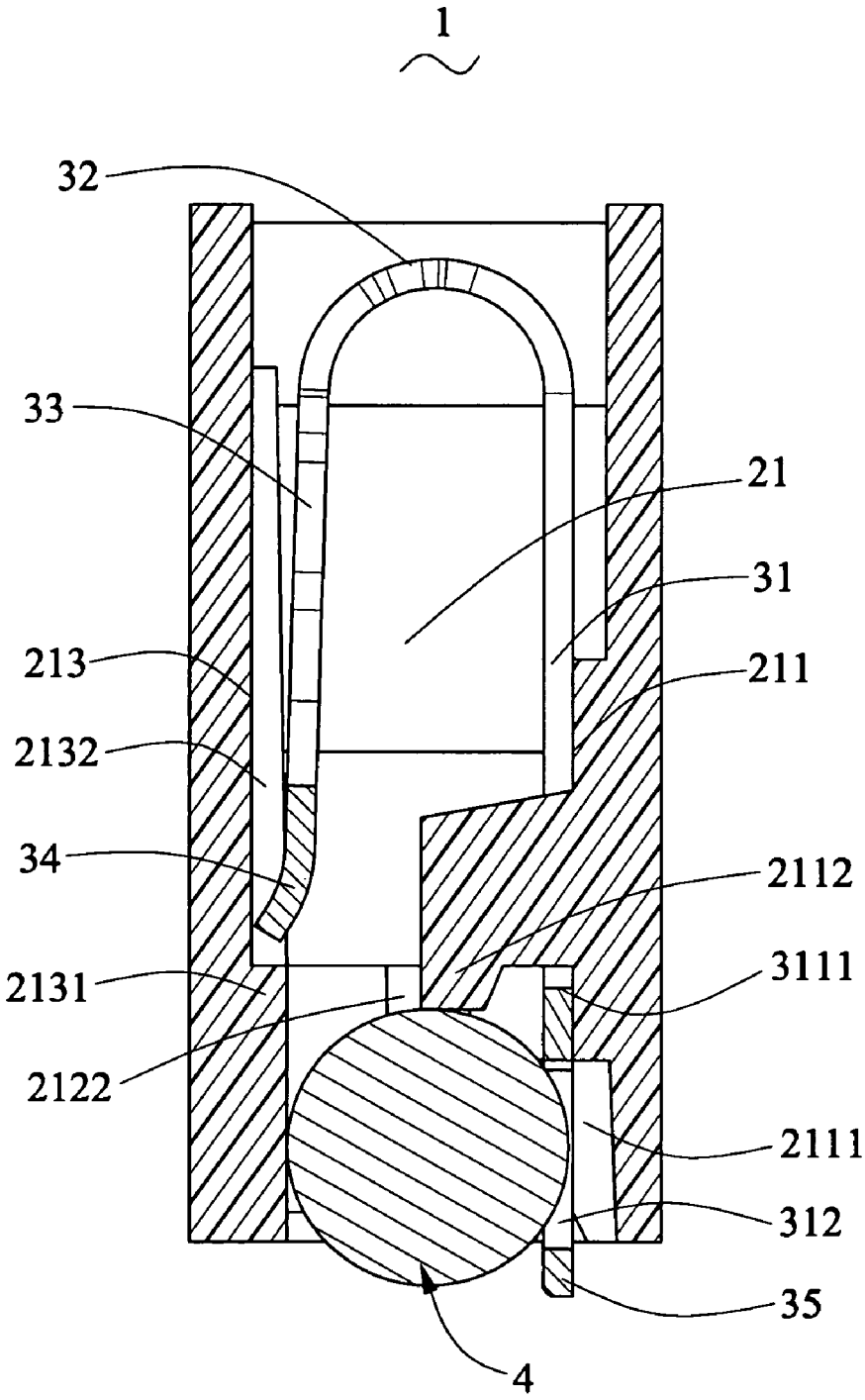
FIG. 3 is a cross-sectional view of the cross-section A-A of the electrical connector in FIG. 2.
Figure 4:
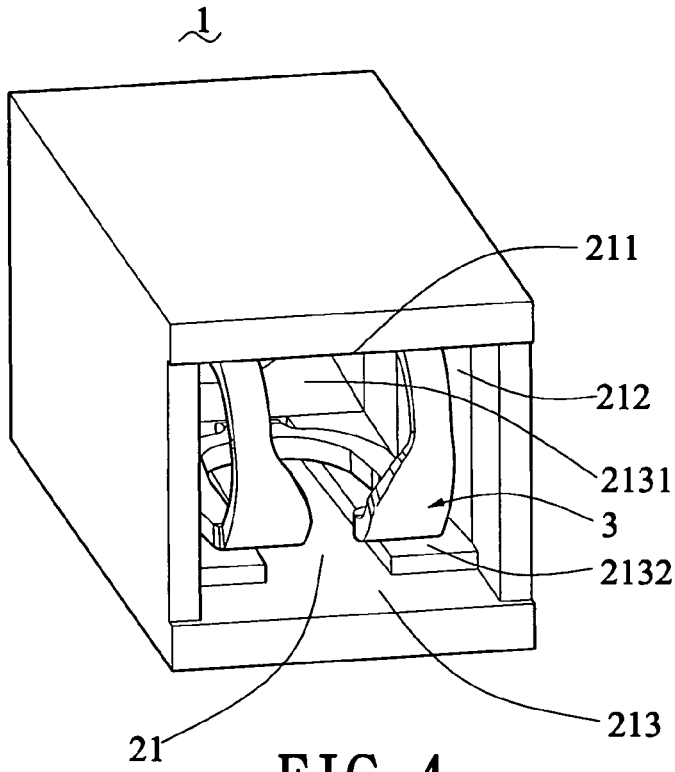
FIG. 4 is another perspective view of the electrical connector in FIG. 2.
Figure 5:
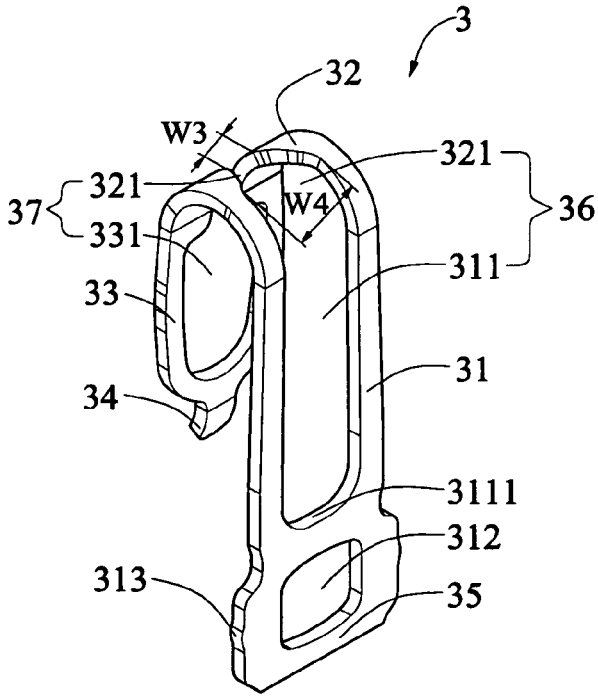
FIG. 5 is a perspective view of the conducting pin of the electrical connector in FIG. 1.
Figure 6:
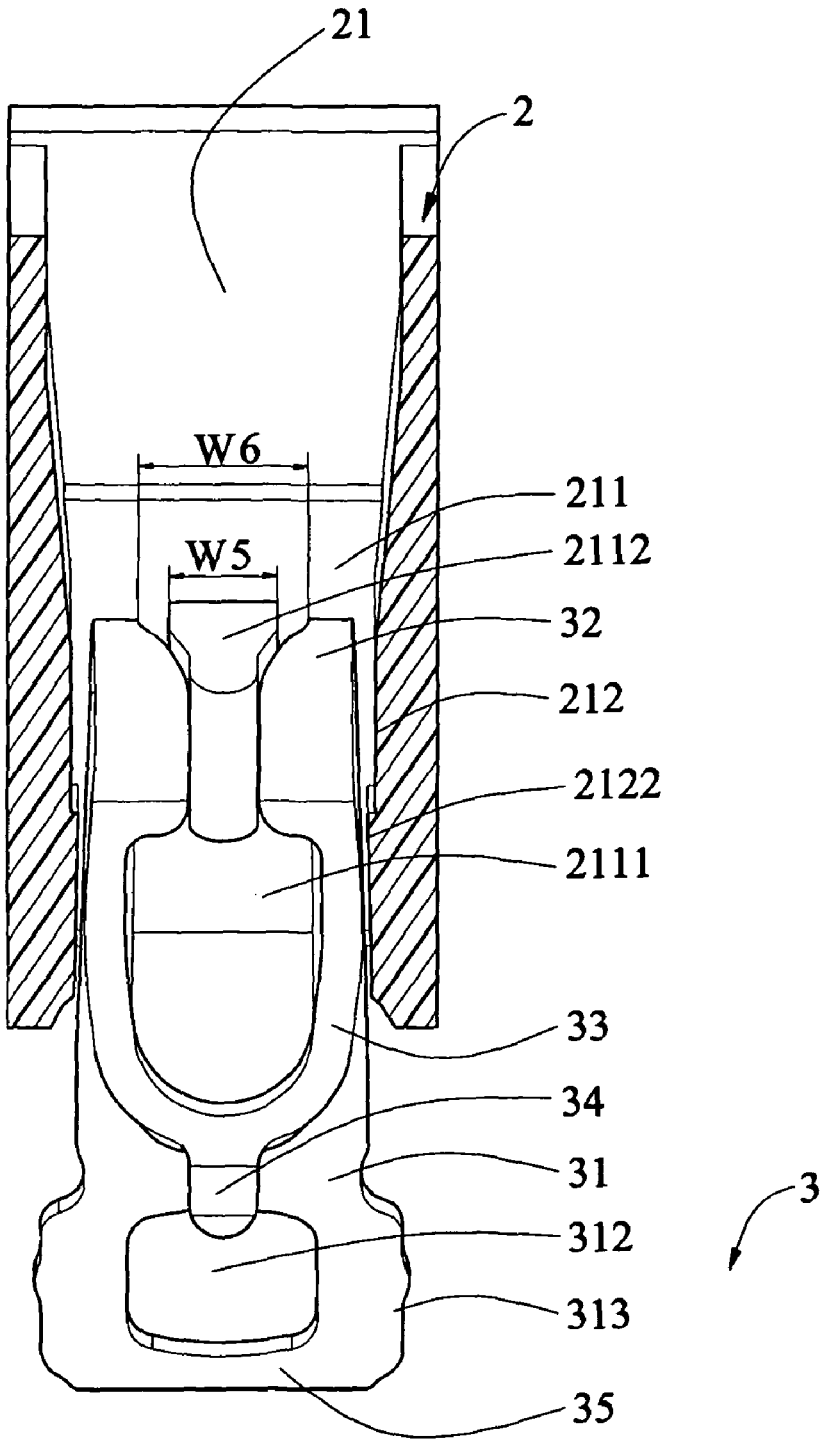
FIG. 6 is a schematic diagram of the conducting pin passing by the convex block when the electrical connector in FIG. 1 is assembled.

Reference is made to FIGS. 3, 5, and 6, each of the conducting pin 3 has a base portion 31. The base portion 31 has a through opening 311. The bottom of the through opening 311 has a bottom portion 3111. The upper side of the base portion 31 is bent and extended to form a U-shaped contacting portion 32. The contacting portion 32 has an opening 321 and the opening links with the through opening 311 to form a channel 36. The contacting portion 32 bends downwards and extends to form a flexible arm 33. The end of the flexible arm 33 bends and extends to form a stop portion 34. A through opening 331 is located above the stop portion 34, and the through opening 331 links with the opening to form a channel 37. The dimension of the opening 321 gradually becomes smaller from the base portion 31 to the flexible arm 33. This means that the width w3 of the opening located at the side of the flexible arm 33 is smaller than the width w4 of the opening located at the side of the base portion 31. The base portion 31 extends downwards and vertically to form a soldering portion 35. A receiving hole 312 is located above the soldering portion 35. The sides of the bottom of the base portion 31 respectively form a convex portion 313.

Figure 7:
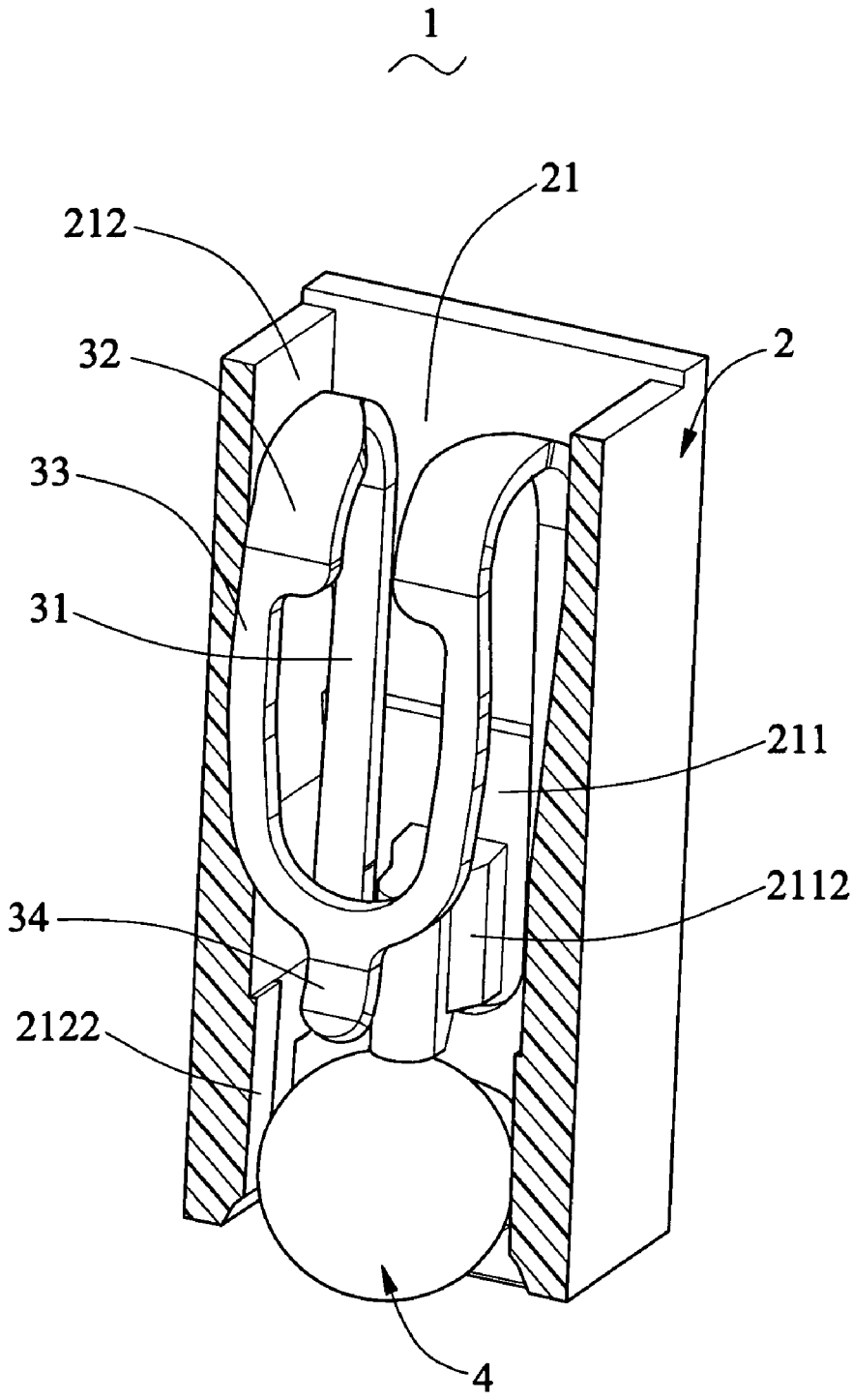
FIG. 7 is a schematic diagram of the electrical connector in FIG. 1 is assembled.

Reference is made to FIGS. 6 and 7. When the electrical connector is assembled, the conducting pin 3 is installed into the through hole 21 from the bottom of the through hole 21. Because the convex block 2112 and the base portion 31 are located at the same side, the conducting pin 3 has a channel 36 corresponding to the convex block 2112, and the width w5 of a position of the convex block 2112 is smaller than the width w6 which corresponds to the position of the channel 36, the channel 36 receives the convex block 2112 when the conducting pin 3 is installed into the through hole 21. This means that the convex block 2112 can pass through the channel 36 without interference. Therefore, the conducting pin 3 will not be damaged due to contact with the convex block 2112. Next, the solder ball 4 is installed into the through hole 21 from the bottom of the through hole 21. The electrical connector is assembled.

Reference is made to FIG. 3. After the electrical connector is assembled, the convex block 2112 is located above the solder ball 4. The convex block 2112 can prevent the solder ball 4 from moving upwards too much in the through hole 21 and be wedged by the inside of the conducting pin 3. The situation of the solder ball 4 being not freely floating is avoided, and assures the solder ball 4 contacts with the circuit board (not shown in the figure) well. The bottom portion 3111 is located below the convex block 2112. The convex block 2112 can prevent the conducting pin 3 from being plugged into the through hole too deep to damage the conducting pin 3. The stop portion 34 is located above the position-block portion 2131 to prevent the conducting pin 3 from dropping out from the through hole 21.

Figure 8:
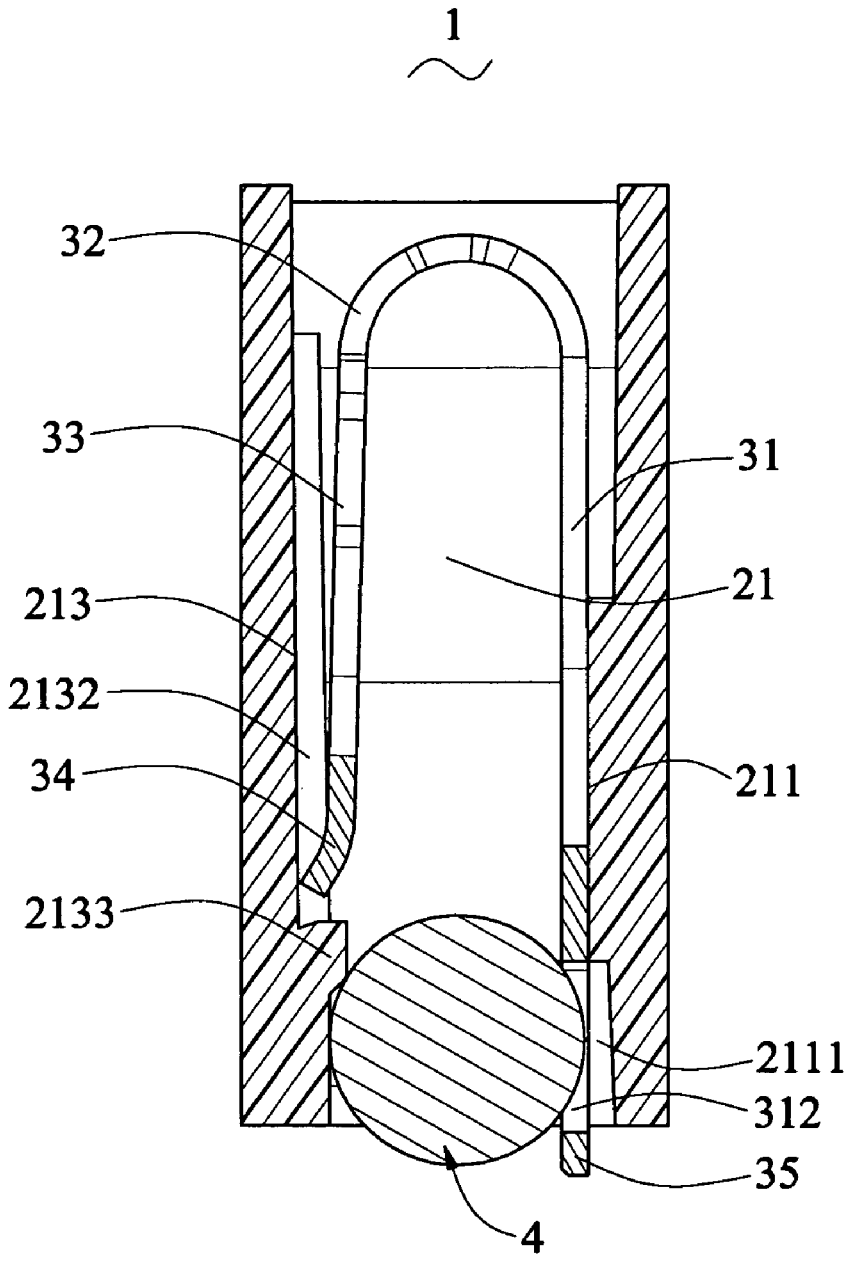
FIG. 8 is a cross-sectional view of the electrical connector of the second embodiment of the present invention.
Figure 9:
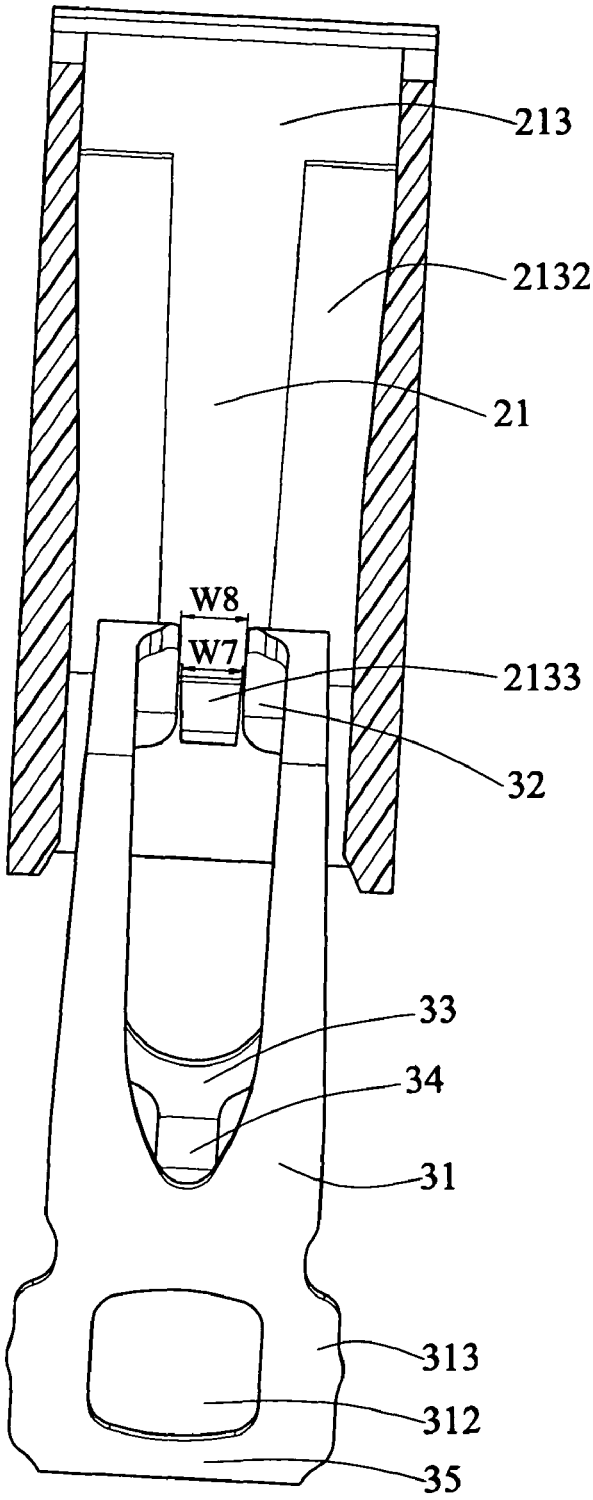
FIG. 9 is a schematic diagram of the conducting pin passing by the convex block when the electrical connector in FIG. 8 is assembled.
Figure 10:
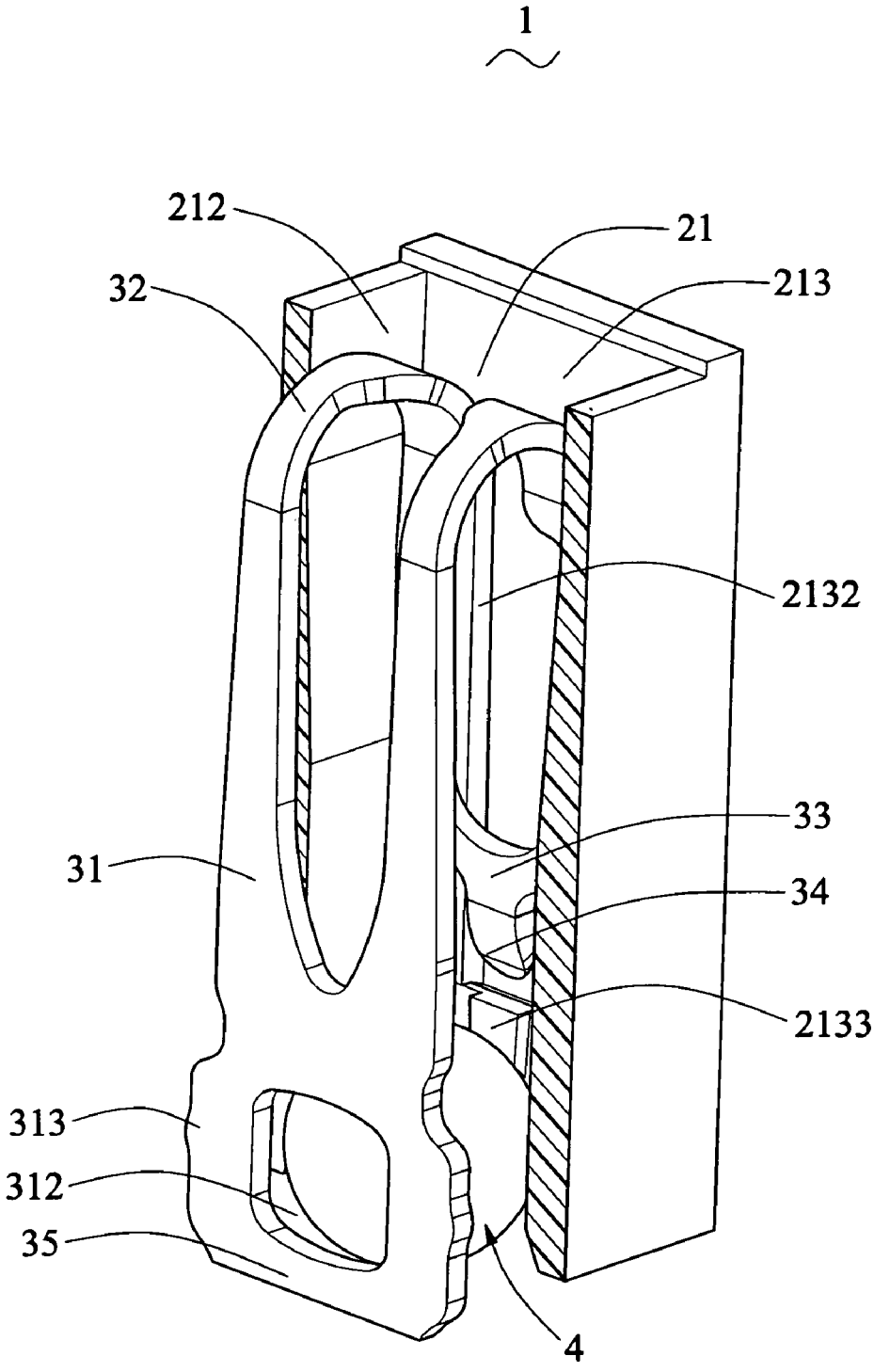
FIG. 10 is a schematic diagram of the electrical connector in FIG. 8 is assembled.
Figure 11:
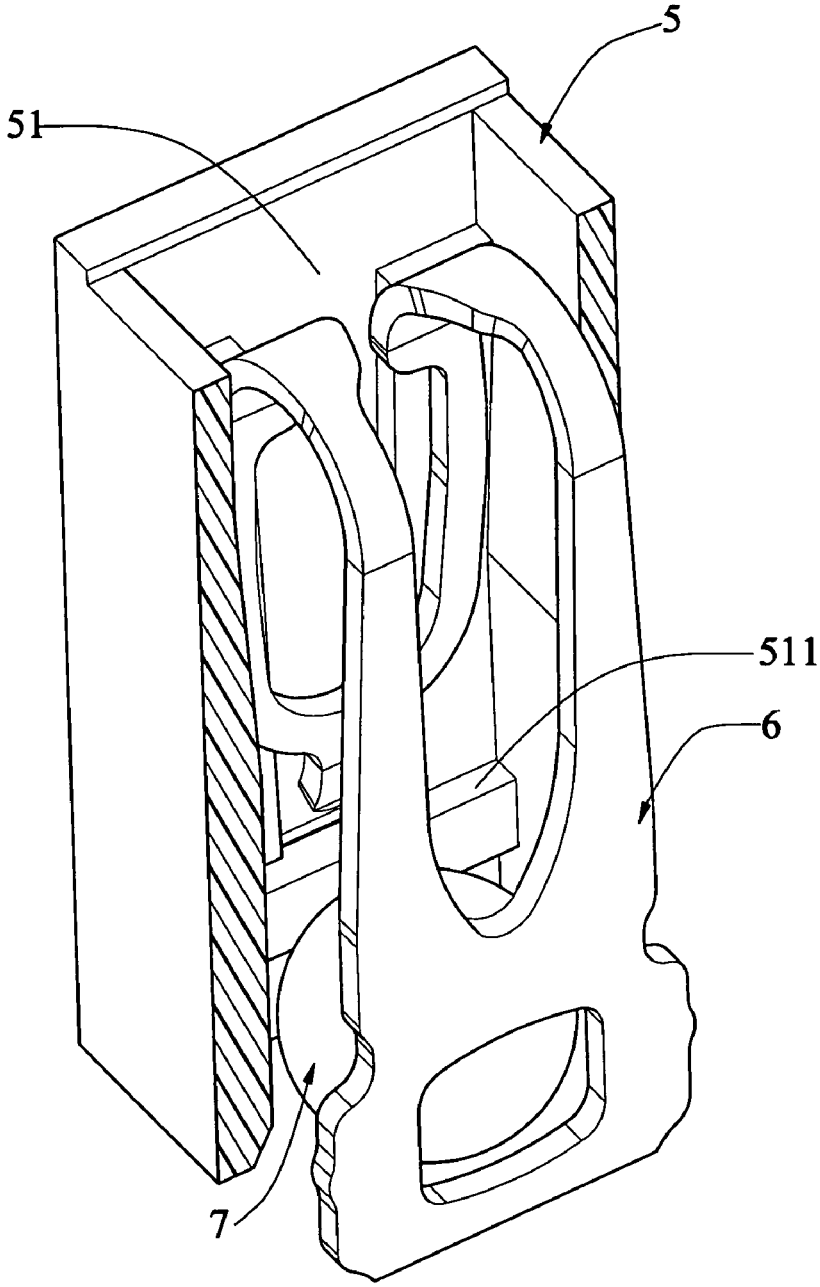
FIG. 11 PRIOR ART
FIG. 11 is a perspective view of the electrical connector of the prior art.
Figure 12:
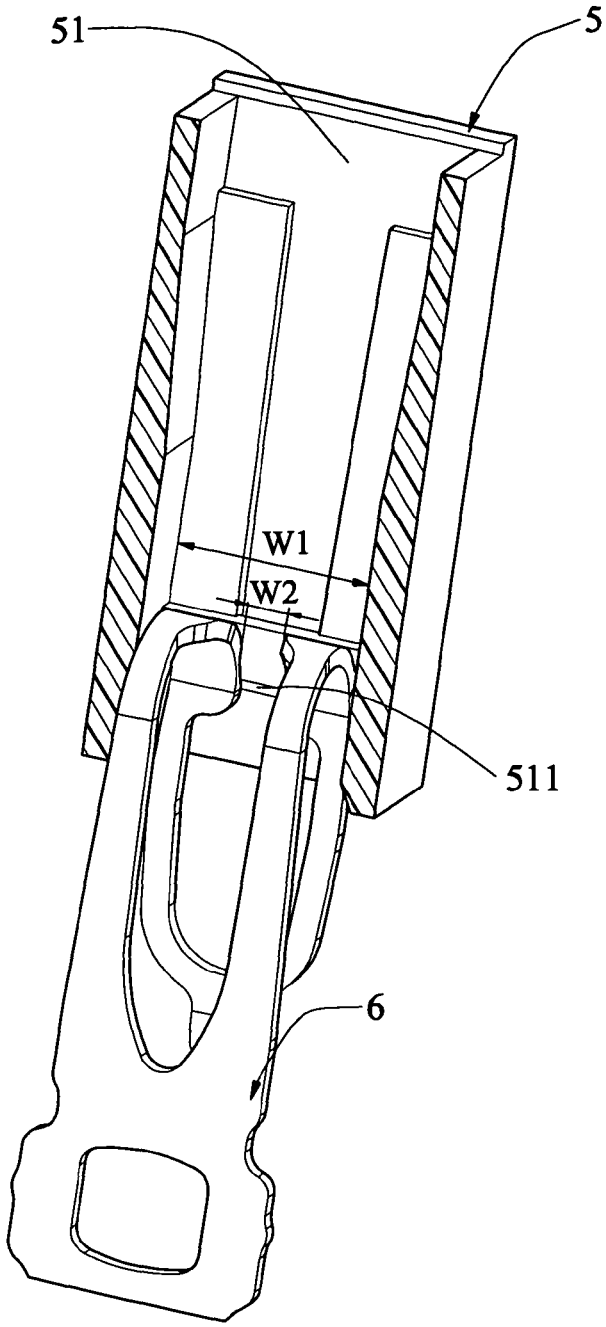
FIG. 12 PRIOR ART
FIG. 12 is schematic diagram of the conducting pin pushing the convex block of the electrical connector in FIG. 11.

Reference is made to FIGS. 8-10, which show the electrical connector of the second embodiment of the present invention. The difference between the second embodiment and the first embodiment is described as followings.

1. In the first embodiment, the convex block 2112 is located at the first side wall 211. In the second embodiment, the convex block 2133 is located at the third side wall 213 that is opposite to the first side wall 211. In the first embodiment, the convex block 2112 and the base portion 31 of the conducting pin are located at the same side. In the second embodiment, the convex block 2133 and the flexible arm 33 are located at the same side.

2. In the first embodiment, the convex block 2112 is located in the channel 36. In the second embodiment, the convex block 2133 is located at outside of the channel 37.

Reference is made to FIGS. 9 and 10. Because the convex block 2133 and the flexible arm 33 are located at the same side, the conducting pin 3 has a channel 37 corresponding to the convex block, and the width w7 of a position of the convex block 2133 is smaller than the width w8 which corresponds to the position of the channel 37, the channel 37 always receives the convex block 2133 when the conducting pin 3 is installed into the through hole 21. This means that the convex block 2133 can pass through the channel 37 without interference. Furthermore, because the flexibility of the bottom of the flexible arm 33 and the stop portion 34 extending from the bottom of the flexible arm 33 is good, the convex block 2133 can easily pass through the bottom of the flexible arm 33 and the stop portion 34. Therefore, the conducting pin 3 will not be damaged due to contact the convex block 2133.

The electrical connector 1 of the present invention has the following characteristics:

1. Because the conducting pin 3 has a channel 36 that can make the convex block 2112 pass through the channel 36 without interference, the convex block 2112 corresponds to the channel 36, and the width w5 of a position of the convex block 2112 is smaller than the width w6 which corresponds to the position of the channel 36, the channel 36 receives the convex block 2112 when the conducting pin 3 is installed into the through hole 21. Therefore, the conducting pin 3 will not be damaged due to contact the convex block 2112 when the conducting pin 3 is installed into the through hole 21, and assure the conducting pin 3 exactly conducting with the electronic element (not shown in the figure). Next, the solder ball 4 is installed into the through hole 21 from the bottom of the through hole 21. The electrical connector is assembled.

2. Because the convex block 2112 is located above the solder ball 4, the convex block 2112 can prevent the solder ball 4 from moving upwards too much in the through hole 21 to be wedged by the inside of the conducting pin 3. The situation of the solder ball 4 being not freely floating is avoided, and assures the solder ball 4 being contacted with the circuit board (not shown in the figure) well.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An electrical connector, comprising:

a base having a plurality of through holes, wherein there is a convex block located at the side wall of the base for each of the through holes; and a plurality of conducting pins respectively located in the through holes, wherein each of the conducting pins has an arm portion, the arm portion and the convex block are located at the same side, the arm portion has a through opening, one end of the arm portion is bent and extended to form a contacting portion, and the contacting portion has an opening that links with the through opening to form a channel that makes the convex block pass through the channel without interference.

2. The electrical connector as claimed in claim 1, wherein the convex block is located in the channel.

3. An electrical connector, comprising:

a base having a plurality of through holes, wherein there is a convex block located at the side wall of the base for each of the through holes; and a plurality of conducting pins respectively located in the through holes, wherein each of the conducting pins has an arm portion, the arm portion and the convex block are located at the same side, the arm portion has a through opening, one end of the arm portion is bent and extended to form a contacting portion, the contacting portion has an opening that links with the through opening to form a channel that corresponds to the convex block, and the width of a position of the convex block is smaller than the width which corresponds to the position of the channel.

4. An electrical connector, comprising:

a base having a plurality of through holes, wherein there is a convex block located at the side wall of the base for each of the through holes; and a plurality of conducting pins respectively located in the through holes, wherein each of the conducting pins has an arm portion, the arm portion and the convex block are located at the same side, the arm portion has a through opening, one end of the arm portion is bent and extended to form a contacting portion, and the contacting portion has an opening that links with the through opening to form a channel that always receives the convex block when the conducting pin is installed into the through hole.

5. The electrical connector as claimed in claim 1, wherein the arm portion is a base portion.

6. The electrical connector as claimed in claim 5, wherein a free end of the contacting portion bends and extends to form a flexible arm.

7. The electrical connector as claimed in claim 1, wherein the electrical connector further comprises a plurality of soldering materials that respectively are received in the through hole, and the convex block is located above the soldering material.

* * * * *